US011686104B2

(12) United States Patent
MacDaniel, Jr.

(10) Patent No.: US 11,686,104 B2
(45) Date of Patent: Jun. 27, 2023

(54) FLEXIBLE, PROFILE BAR SCREEN

(71) Applicant: Hendrick Screen Company, Owensboro, KY (US)

(72) Inventor: David C. MacDaniel, Jr., Thornhurst, PA (US)

(73) Assignee: Hendrick Screen Company, Owensboro, KY (US)

( * ) Notice: Subject to any disclaimer, the term of this patent is extended or adjusted under 35 U.S.C. 154(b) by 98 days.

(21) Appl. No.: 17/020,005

(22) Filed: Sep. 14, 2020

(65) Prior Publication Data

US 2021/0079661 A1 Mar. 18, 2021

Related U.S. Application Data

(60) Provisional application No. 62/900,036, filed on Sep. 13, 2019.

(51) Int. Cl.

| | |
|---|---|
| ***E04F 13/078*** | (2006.01) |
| ***E04F 13/07*** | (2006.01) |
| ***E04F 13/08*** | (2006.01) |
| ***E04F 13/00*** | (2006.01) |

(52) U.S. Cl.

CPC ..... *E04F 13/0871* (2013.01); *E04F 13/002* (2013.01); *E04F 13/005* (2013.01); *E04F 13/081* (2013.01)

(58) Field of Classification Search

CPC ... E04F 13/0871; E04F 13/002; E04F 13/005; E04F 13/08; E04F 13/081; E04F 13/0812; E04F 13/0817; E04F 13/0858

See application file for complete search history.

(56) References Cited

U.S. PATENT DOCUMENTS

| | | | | | |
|---|---|---|---|---|---|
| 93,789 | A * | 8/1869 | Worth | A47J 37/1295 | 52/222 |
| 2,827,138 | A * | 3/1958 | Roy, Jr. | A01G 9/16 | 52/86 |
| 3,548,904 | A * | 12/1970 | Mackell | E04H 15/20 | 52/2.21 |
| 4,224,864 | A * | 9/1980 | Wendell | A47J 37/1295 | 99/349 |
| 4,326,363 | A * | 4/1982 | Leonhardt | E04H 5/12 | 52/83 |
| 5,027,564 | A * | 7/1991 | Lechner | E04B 1/3211 | 52/222 |
| 5,050,924 | A * | 9/1991 | Hansen | B60P 7/0876 | 410/97 |
| 5,522,184 | A * | 6/1996 | Oviedo-Reyes | E04H 9/14 | 52/DIG. 11 |
| 5,687,512 | A * | 11/1997 | Spoozak | E04H 9/14 | 52/156 |
| 5,966,877 | A * | 10/1999 | Hawes | E04G 21/30 | 52/63 |

(Continued)

*Primary Examiner* — Phi D A
(74) *Attorney, Agent, or Firm* — Thomas E. Lees, LLC

(57) ABSTRACT

A flexible, profile-bar-based screen is provided includes a flexible cord (e.g., a braided stainless-steel cable) that strings together several cross members (e.g., profile bars) in a pattern to create the screen. Flexible spacers ensure that the cross members remain generally parallel, while allowing the cord to flex in any direction. Each end of the cord includes a cap (e.g., nut, washer, tacking, etc., combinations thereof) to prevent edge cross members from falling off the cord.

7 Claims, 5 Drawing Sheets

(56) References Cited

U.S. PATENT DOCUMENTS

| | | | | |
|---|---|---|---|---|
| 6,070,371 | A * | 6/2000 | Myrick | E04G 21/28 52/63 |
| 7,654,042 | B1 * | 2/2010 | Brown | E04H 9/14 52/93.2 |
| 8,387,313 | B2 * | 3/2013 | Hamlin, III | E04D 5/142 52/410 |

* cited by examiner

FLEXIBLE, PROFILE BAR SCREEN

CROSS REFERENCE TO RELATED APPLICATIONS

This application claims the benefit of U.S. Provisional Patent Application Ser. No. 62/900,036, filed Sep. 13, 2019, entitled "FLEXIBLE, PROFILE BAR SCREEN", the disclosure of which is hereby incorporated by reference.

BACKGROUND

Various aspects of the present invention relate generally to profile-bar-based screens and specifically to a flexible, profile-bar-based architectural screen.

Architectural screens may be used to decorate a building, as entrance grilles and grating, as tree grating, etc.

BRIEF SUMMARY

According to aspects of the present invention, a flexible, profile-bar-based screen is provided includes a flexible cord (e.g., a braided stainless-steel cable) that strings together several cross members (e.g., profile bars) in a pattern to create the screen. Flexible spacers ensure that the cross members remain generally parallel, while allowing the cord to flex in any direction. Each end of the cord includes a cap (e.g., nut, washer, tacking, etc., combinations thereof) to prevent edge cross members from falling off the cord.

DETAILED DESCRIPTION

A flexible, profile-bar-based screen is provided includes a flexible cord (e.g., a braided stainless-steel cable) that strings together several cross members (e.g., profile bars) in a pattern to create the screen. Flexible spacers ensure that the cross members remain generally parallel, while allowing the cord to flex in any direction. Each end of the cord includes a cap (e.g., nut, washer, tacking, etc., combinations thereof) to prevent edge cross members from falling off the cord. Usually at least two cords are used to prevent the cross members from rotating about the cord.

Such a flexible, profile-bar-based screen has several advantages over traditional profile bar screens. For example, the flexible, profile-bar-based screen can wrap around curved walls instead of being limited to straight walls, provide a curved transition between a wall and a ceiling, or go up/down a staircase. Further, the flexible, profile-bar-based screen can be made in bulk and sold as a roll, where users can then cut to whatever size is required for a specific application and then add the caps. On the other hand, the ends of the screens may include couplers (shoulder bolt and keyhole lock, bead chain, S-hook, snaps, toggle latch systems, etc.) that allow one screen to be coupled to another screen.

Further, with existing profile bar screens, a tray is used to lock and hold the profile bars (i.e., cross members) in place. However, no such tray is needed (and would not be practical for any pattern except a flat pattern) for the flexible profile bar screens described herein.

Figure 1:
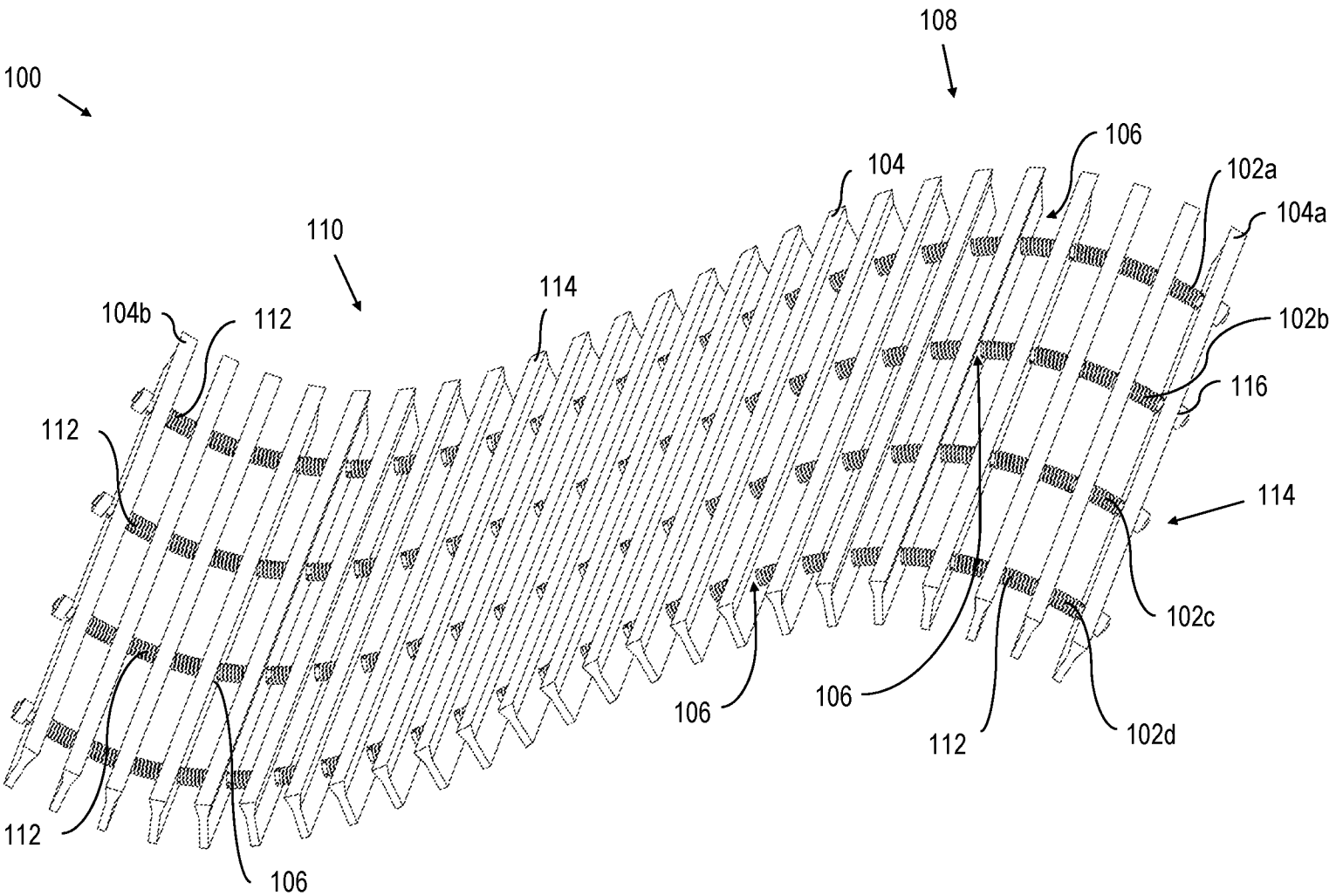
FIG. 1 is an isometric view of a flexible, profile-bar-based screen, according to various aspects of the present disclosure.

Turning now to the figures, and in particular FIG. 1, a flexible screen 100 is shown with four flexible cords 102*a-d* and several cross members 104. The flexible cords 102*a-d* may be made of any strong, flexible material (e.g., braided stainless steel cable, chain, solid or braided metals, solid or braided plastics, etc.). Further, the cross members 104 may be any desired material (e.g., profile bar). The cords 102*a-d* run through the cross members 104 at apertures 106 within the cross members 104. As the cords 102 are flexible, they may flex in any direction to create shapes with curves in either direction (e.g., a convex curve 108 with an outside of the curve near a top of the cross members, a concave curve 110 with an outside of the curve near a bottom of the cross members).

Spacers 112 are between the cross members 104 to ensure spacing between the cross members 104. For example, the spacers 112 can ensure the cross members 104 remain generally parallel to each other looking from the top down (i.e., the cross members are each generally orthogonal to the cord). The spacers 112 themselves are also flexible. For example, each spacer 112 may be a coiled spring (e.g., compressed springs, extended springs) that surround a portion of the cord 102 between the cross members 104. Other types of spacers 112 may be used as well (rubber spacers, a stainless steel bead, stainless steel beads in series, etc.), but the spacers 112 should be flexible between the cross members 104.

Each of the ends 114 of the cords 102 has a cap 116 that prevents the edge cross members 104*a-b* from falling off the cords 102. The caps 116 can be anything that would prevent the edge cross members 104*a-b* from falling off the cords 102 (e.g., thick washers larger than the apertures, nuts larger than the apertures, tacking, crimping, etc., or combinations thereof).

Figure 2:
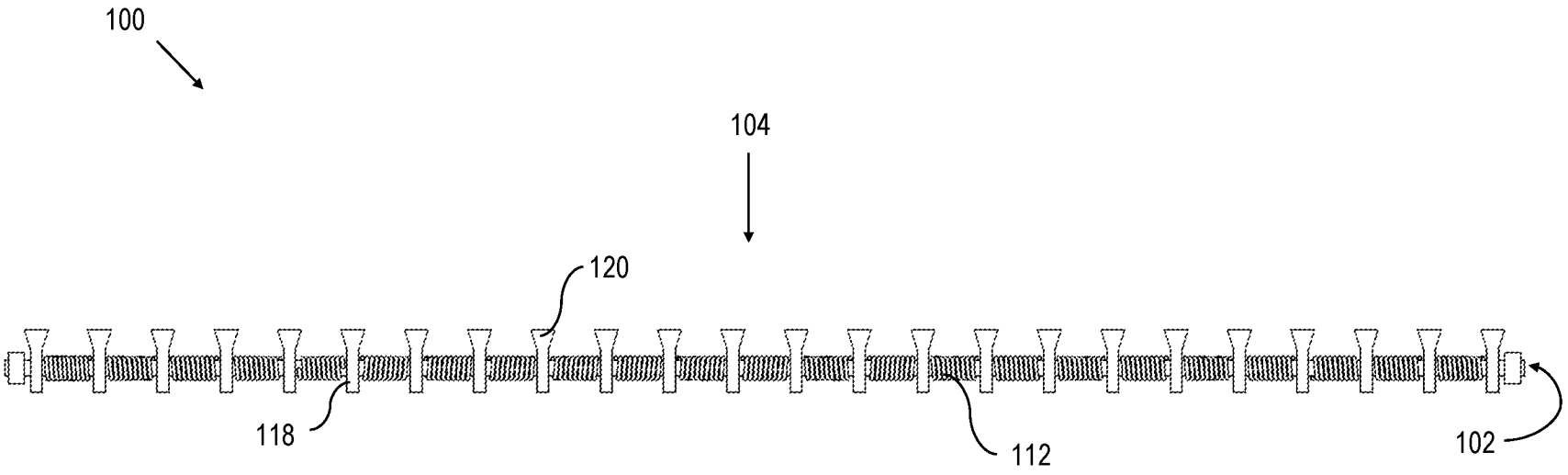
FIG. 2 is a side view of the flexible, profile-bar-based screen in a flattened arrangement, according to various aspects of the present disclosure.
Figure 3:
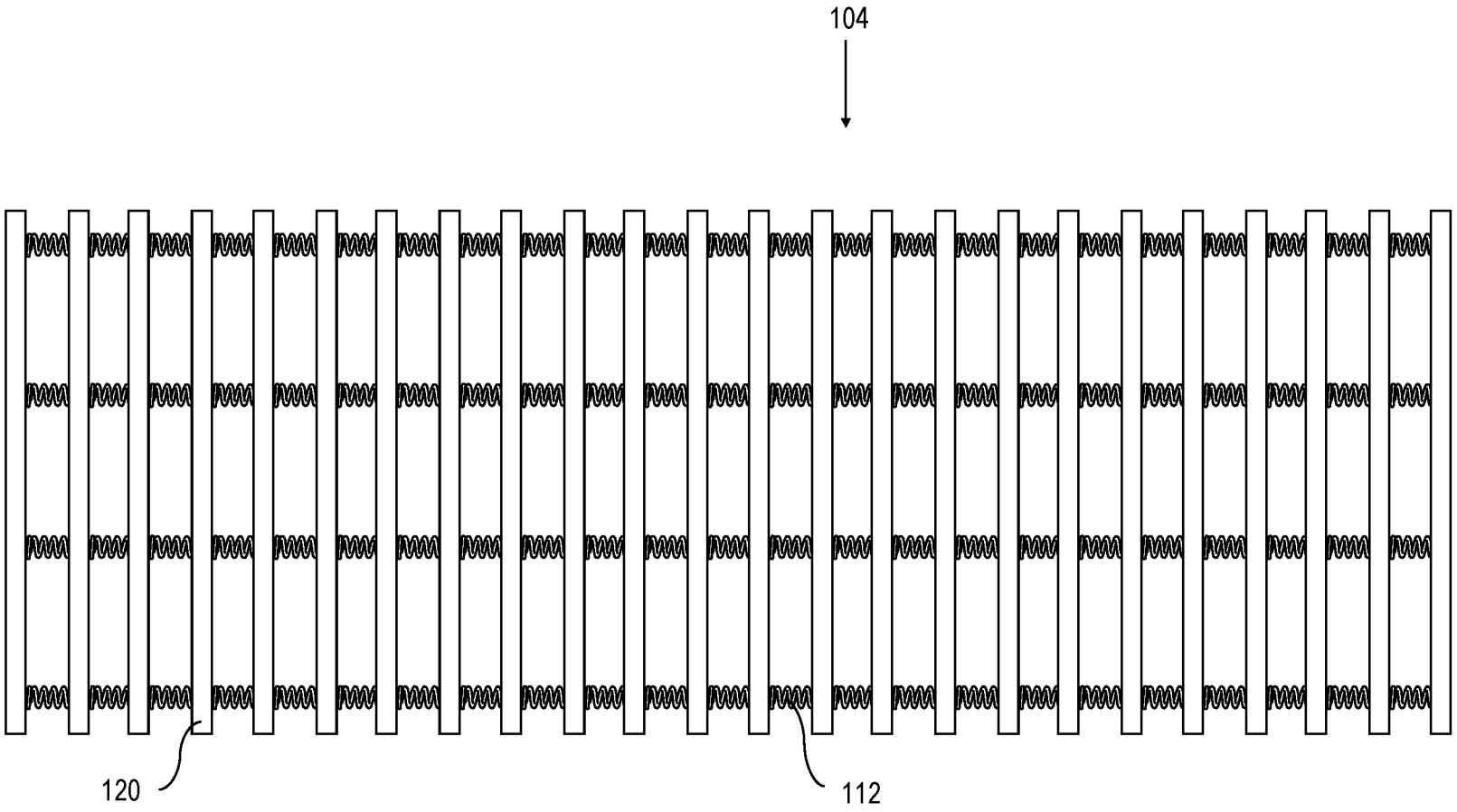
FIG. 3 is a top view of the flexible, profile-bar-based screen in a flattened arrangement, according to various aspects of the present disclosure.

FIG. 2 illustrates a side view of the flexible, profile-bar based screen 100 in a flattened position. The profile bar cross members 104 each include a stem 118 and a flat head 120. In the flattened position, the stems 118 are generally vertically parallel as shown in FIG. 2. Further, the flat heads 120 are horizontal. Moreover, the profile bars 104 (i.e., the cross members) are parallel in the depth direction, as shown in FIG. 3. As shown in FIGS. 2-3, spacing between the profile bars 104 is uniform. However, the spacing between the profile bars 104 may be different (i.e., variable).

Further, the spacing between profile bars 104 along the first cord (see FIG. 1, 102*a*) may be different than the spacing between the same two profile bars along the second cord (see FIG. 1, 102*d*). Such an arrangement allows for the screen 100 to lay flat in a circle (e.g., as a grate around a tree).

Figure 4:
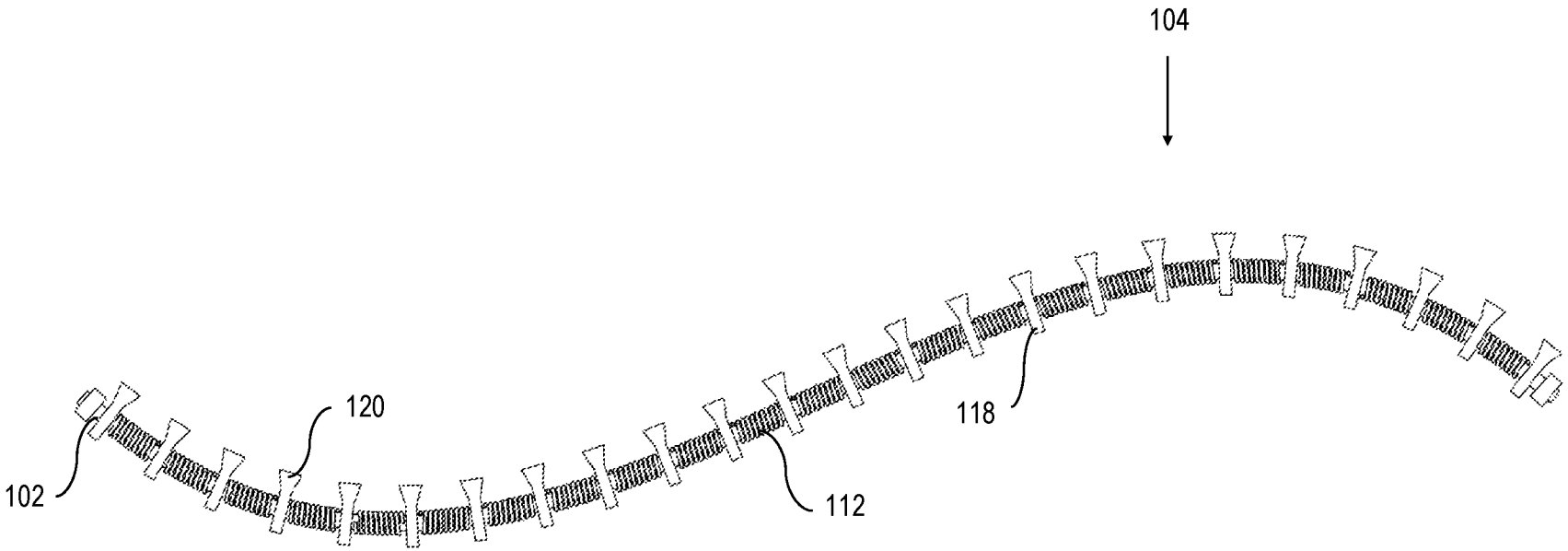
FIG. 4 is a side view of the flexible, profile-bar-based screen in a curved (e.g., sinusoidal) configuration, according to various aspects of the present disclosure.

Turning now to FIG. 4, the flexible, profile-bar based screen 100 is shown shifted from the flattened position to a sinusoidal position. From the side view, the spacing of the cross bars 104 along the cord 102 remains essentially the same throughout due to the flexible spacers 112. However, the stems 118 are no longer parallel, and the heads 120 do not make a flat surface. On the other hand, a view from the top will show that the heads cross members themselves are still parallel from that angle. Thus, using the flexible cord 102 allows users to curve the screen to fit different shapes, as discussed above.

Figure 5:
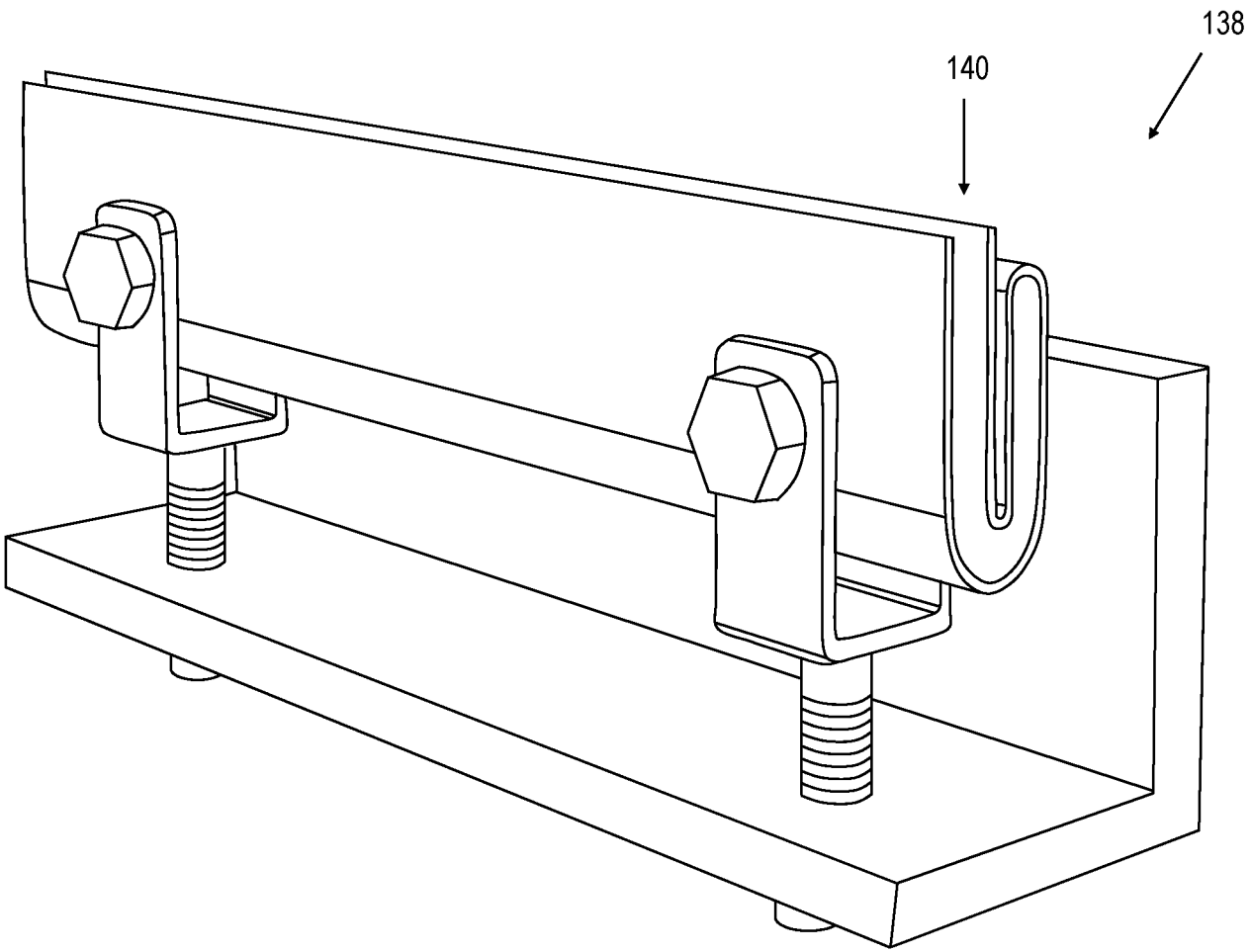
FIG. 5 is a diagram of a mounting system for the flexible, profile-bar-based screen, according to various aspects of the present disclosure.

The screens as described herein may be mounted to walls, ceilings, stairs, etc. via any standard coupler (e.g., track system, bus bars, eyelets and cords, tension system (see FIG. 5), standoffs, glue mounting systems, hook and loop fasteners, S-hooks, etc.). FIG. 5 illustrates a tension system 138 that includes a channel 140 for the flexible screen to enter and wrap back on itself creating tension. Such tension can fix a flexible screen as an anchor point.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

What is claimed is:

1. A flexible screen comprising:

a first flexible cord, wherein the first flexible cord is braided from flexible strands of metal;

a second flexible cord;

a first cross member including a first aperture and a second aperture, wherein the first cross member is a first profile bar;

a second cross member including a first aperture and a second aperture, wherein the second cross member is a second profile bar;

a third cross member including a first aperture and a second aperture, wherein the third cross member is a third profile bar;

wherein:

the first flexible cord threads through the first aperture of the first cross member, the first aperture of the second cross member, and the first aperture of the third cross member;

the second flexible cord threads through the second aperture of the first cross member, the second aperture of the second cross member, and the second aperture of the third cross member; and spacers, being compressed coiled springs, surround portions of the first flexible cord and the second flexible cord, where the surrounded portions are:

between the first cross member and the second cross member; and between the second cross member and the third cross member.

2. The flexible screen of claim 1, wherein the first flexible cord is continuous from the first cross member to the third cross member.

3. The flexible screen of claim 1, wherein the first flexible cord is solid metal.

4. The flexible screen of claim 1, wherein the first flexible cord comprises stainless steel.

5. The flexible screen of claim 1 further comprising a cap on a first end of the flexible cord.

6. The flexible screen of claim 1, wherein a spacing between the cross members is uniform.

7. The flexible screen of claim 1, wherein a spacing between the cross members is variable.

* * * * *